United States Patent [19]

Nickell

[11] Patent Number: 4,747,449

[45] Date of Patent: May 31, 1988

[54] HEAT EXCHANGER FOR LIQUIDS

[75] Inventor: Shelby W. Nickell, Constantine, Mich.

[73] Assignee: E. L. Nickell Co., Inc., Constantine, Mich.

[21] Appl. No.: 891,004

[22] Filed: Jul. 25, 1986

[51] Int. Cl.[4] ..... F28F 19/00; F28F 9/02

[52] U.S. Cl. ..... 165/134.1; 165/158

[58] Field of Search ..... 165/158, 134.1

[56] References Cited

U.S. PATENT DOCUMENTS

| | | | |
|---|---|---|---|
| 1,367,881 | 2/1921 | Lea | 165/158 |
| 2,028,455 | 1/1936 | Karmazin | 165/158 |
| 2,083,679 | 6/1937 | Adams | 165/158 |
| 2,183,956 | 12/1939 | Campbell et al. | 165/158 X |
| 2,301,113 | 11/1942 | Ettington et al. | 165/158 X |
| 3,030,782 | 4/1962 | Karmazin | 165/158 |
| 3,527,290 | 9/1970 | Lossing | 165/158 |
| 3,804,161 | 4/1974 | Nowak | 165/158 |
| 4,208,529 | 6/1980 | Murray | 165/158 X |
| 4,363,355 | 12/1982 | Prucyk | 165/158 |
| 4,474,011 | 10/1984 | Nelson | 165/158 |
| 4,602,672 | 7/1986 | Kaufmann | 165/139 X |

*Primary Examiner*—Ira S. Lazarus

*Assistant Examiner*—Peggy Neils

*Attorney, Agent, or Firm*—Jeffers, Hoffman & Niewyk

[57] ABSTRACT

A heat exchanger for cooling liquid food products includes an elongated shell through which a refrigerant can be recirculated and hollow tubes extending within the shell interior in parallel spaced relation between its opposite ends for carrying the liquid food product. A pair of electropolished stainless steel tube sheets are attached to opposite ends of the shell and have openings defined therethrough. The tube sheets support the hollow tubes at their opposite ends in communication with the openings. Also, a pair of electropolished stainless steel end bonnets are releasably attached to the tube sheets and mounted for pivotal movement between opened and closed positions relative thereto. The end bonnets have flow return pockets defined therein which communicate pairs of openings with one another independently of others of the openings. The respective attached pairs of tube sheets and end bonnets have flat end surfaces which face toward one another and make mating contact with one another between the tube sheet and end bonnet pairs at opposite ends of the shell and about individual ones of the openings and pockets defined therein.

3 Claims, 3 Drawing Sheets

HEAT EXCHANGER FOR LIQUIDS

BACKGROUND OF THE INVENTION

The present invention generally relates to cooling of liquid food products and, more particularly, is concerned with a heat exchanger employing improvements which enhance its flow, sealing and sanitary characteristics for improved operating efficiency in cooling such products.

One general type of heat exchanger used in chilling, or cooling, a wide variety of liquid food products, such as crushed grapes, orange pulp and the like, employs an elongated cylindrical shell having a hollow interior which houses a plurality of tubes arranged parallel to one another. The tubes extend between headers or end plates on opposite ends of the shell. The end plates commonly have cavities or mount U-shaped tubes which communicate with the ends of the tubes for allowing reversal of flow through the tubes.

Typically, a liquid product is pumped into the heat exchanger through an inlet in one end plate and then through the plurality of tubes and end cavities and out of the heat exchanger through an outlet in the same one end plate. Concurrently, a refrigerant is introduced on the shell side which carries the heat off the fluid on the tube side.

In one prior art heat exchanger manufactured and marketed heretofore by the assignee of the present invention, each end plate (or bonnet) is rounded in shape and has a series of generally parallel partitions fixed across its interior side so as to define reversing flow cavities which communicate with the ends of more than two tubes and have much larger cross-sectional flow areas than the tubes. Each rounded end plate also has an annular flange which is attached by a series of bolts to an annular flange on the end of the shell to close the same. The end plate and shell flanges have respective flat faces thereon which are drawn close together so as to compress a flat annular gasket therebetween to seal the shell end as the end plate is attached to the shell.

Typical constructions of other prior art heat exchangers are represented by those disclosed in U.S. Pat. No. 3,030,782 to Karmazin, No. 3,527,290 to Lossing, No. 3,804,161 to Nowak, No. 4,363,355 to Prucyk, and No. 4,474,011 to Nelson et al. The heat exchangers of these patents as well as the one described above in detail each embodies one or more shortcomings. Some are unduly complex and expensive in terms of the number of parts and manufacturing steps needed to construct them. Others are complicated in terms of the gaskets and fittings required to seal them. Still others provide abrupt changes in the cross-sectional areas of the flow reversing chambers at the ends of the shells compared to the cross-sectional areas of the tubes, which increases pressure drop and pumping power requirements. Yet others would be tedious and time-consuming to clean and maintain in a sanitary condition to chill liquid food products.

A significant disadvantage to prior art heat exchangers is the amount of turbulence which is introduced in the chambers where flow is reversed from one tube to another. This turbulence substantially increases the pressure drop of the liquid as it flows from one tube to another, and when this pressure drop is multiplied by the number of flow reversals that occur as the liquid passes through the heat exchanger, its cumulative effect is quite significant. This requires the use of larger pumps, and the higher pressures that result cause leakage and gasket failures.

Consequently, a need exists for improvements in the construction of heat exchangers, especially those intended to be used to cool liquid food products, which will overcome the aforementioned shortcomings without introducing new ones.

SUMMARY OF THE INVENTION

The present invention provides improvements in heat exchanger construction designed to satisfy the aforementioned needs. The present invention encompasses several different improvements which substantially eliminate the above-cited shortcomings.

One improvement is that the facing surfaces provided on the end bonnets and tube sheets of the heat exchanger are substantially perfectly flat so that a substantially liquid tight metal to metal mating contact can be made at the ends of the shell without the necessity for gasketing between such surfaces about the individual pockets and openings therein. In prior art heat exchangers, complex and expensive gaskets were required to provide a fluid tight seal between adjacent tubes or groups of tubes. When the heat exchanger requires cleaning, which occurs quite frequently, the gaskets would invariably be destroyed as the bonnets are pulled away from the tube sheets, thereby requiring replacement. The necessity for providing gasketing between adjacent tubes creates spaces where food particles can be trapped, thereby potentially leading to the growth of bacteria. This improvement provides substantial advantages in terms of the ease with which the bonnets can be opened and the tube sheets and bonnets cleaned and thereby maintained in a sanitary condition free of bacterial growth.

Another improvement is that a plurality of flow reversing or return pockets are defined in each of the end surfaces of the end bonnets. Each pocket provides a separate and independent flow path between the ends of a pair of the liquid product carrying tubes. The pockets are sized and contoured such that the cross-sectional flow area of each is substantially identical to that of each of the openings and have smooth, rounded corners. These pockets are easier and less costly to fabricate and occupy much less space in the end bonnets than U-shaped tubes or passages such as employed in the Lossing patent. Pockets having cross-sectional flow areas matched to that of the openings also avoid the creation of a flow restriction or abrupt change in pressure which tends to adversely change pressure drop and increase pumping power requirements.

By providing the pockets within an integral plate, the necessity for attaching separate U-tubes or end caps to the plate is avoided. Of course, whenever two parts are joined together, the points at which they are joined or seamed are potential leak paths. Also, if it is necessary to weld the parts together, the welding creates surface irregularities which increase friction and can trap food particles.

A further improvement is that the tube sheets and end bonnets which come in contact with the liquid food product are composed of stainless steel which has been electropolished. Eletropolishing not only finely polishes the end surfaces but also removes free carbon molecules that normally would be contained within the pores of the material. Without such electropolishing, carbon would be released by the passage of liquid through the heat exchanger and become entrained with the food product thereby degrading it.

Accordingly, the present invention, in one form thereof, relates to an improved heat exchanger useful for cooling liquid food products which comprises an elongated shell having opposite ends and a hollow interior through which a refrigerant can be recirculated. A plurality of hollow tubes are housed within the interior of the shell and extend in spaced relation to one another between the opposite ends thereof for carrying the liquid food product. A pair of tube sheets attached to the respective opposite ends of the shell have respective pluralities of openings that support the hollow tubes at opposite ends thereof. A pair of end bonnets are releasably attached to the respective tube sheets, the end bonnets having respective flow return means which communicate the openings with one another, the tube sheets and end bonnets having flat end surfaces which face toward one another and make liquid tight mating contact with one another about individual ones of the tube and sheet openings and flow return pockets of the bonnets.

More particularly, each pocket has a longitudinal axis which extends generally parallel to the end surface and each pocket is arranged to communicate a respective pair of the tube openings with one another independently of and separately from others of the tube openings. The tube openings in each pair communicate with one another by one pocket and have respective central axes which extend generally perpendicular to the longitudinal axis of the one pocket. Also, each pocket preferably has a cross-sectional flow area substantially the same as that of each of the openings in the pair.

In a preferred embodiment, each of the tube sheets has a circular recess defined in its end surface spaced inwardly of a peripheral edge of the surface and outwardly of the openings defined in the tube sheet, with the recess encompassing the openings as a group. A sealing ring gasket is disposed in the circular recess and compressed therein when a respective one of the end bonnets is clamped to the tube sheet with their end surfaces in mating contact.

Still further, each of the tube sheets and end bonnets is composed of electropolished stainless steel. Each end bonnet is mounted at a respective one end of the shell for pivotal movement between opened and closed positions relative to one of the tube sheets.

These and other advantages and attainments of the present invention, in an exemplary form thereof, will become more apparent to those skilled in the art upon a reading of the following detailed description when taken in conjunction with the drawings wherein there is shown and described an illustrative embodiment of the invention.

BRIEF DESCRIPTION OF THE DRAWINGS

In the course of the following detailed description, reference will be made to the attached drawings in which.

DETAILED DESCRIPTION OF THE INVENTION

Figure 1:
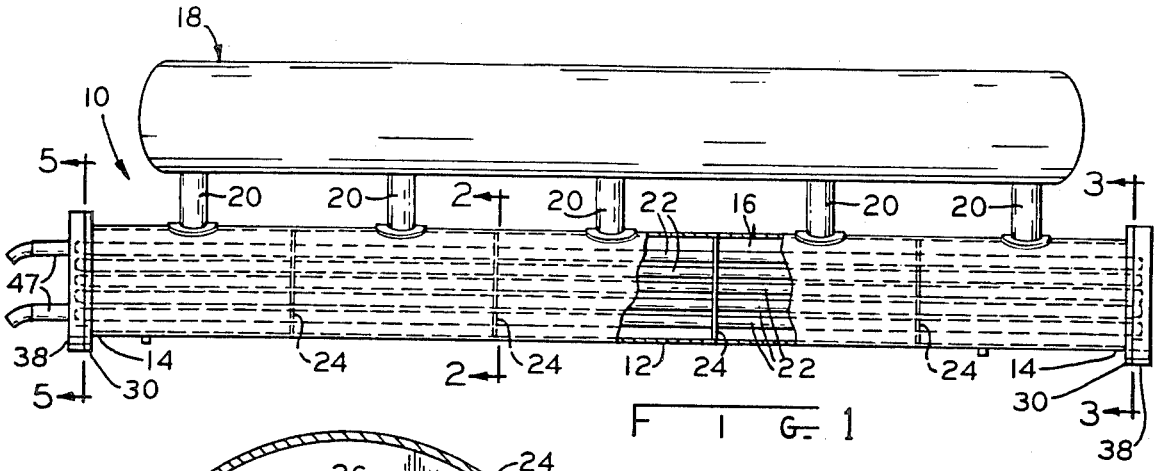
FIG. 1 is a side elevational view of a heat exchanger incorporating the improvements of the present invention.

Referring now to the drawings, and particularly to FIG. 1, there is shown the improved heat exchanger of the present invention, generally designated by the numeral 10. Although not so limited, the improved heat exchanger 10 is particularly adapted for cooling a liquid food product such as crushed grapes including not only the juice of the grapes but also the skins, pulp and seeds.

The heat exchanger 10 has a generally horizontal elongate cylindrical shell 12 with opposite ends 14 and a hollow interior 16. A refrigerant accumulator 18 is supported above the shell 12 of the heat exchanger 10 and connected in flow communication with its interior 16 by a series of conduits 20. Also, a plurality of elongate hollow tubes 22 for carrying the liquid food product are housed within the interior 16 of the shell 12, extending horizontally and in generally parallel spaced relation to one another between the opposite ends 14 of the shell.

As the liquid food product flows through the tubes 22, a refrigerant in liquid phase is introduced through the feed conduits 20 into the interior 16 of the heat exchanger shell 12 and about the exterior of the tubes 22. As heat from the liquid product flowing within the tubes 22 transfers to the liquid refrigerant within the shell 12, the latter evaporates and flows as a vapor upwardly from the shell 12 through feed conduits 20 and from the accumulator 18 to a compressor (not shown) and condenser (not shown) of a refrigeration system. It is then recirculated back as a liquid to shell 12. Such an arrangement is known.

Figure 2:
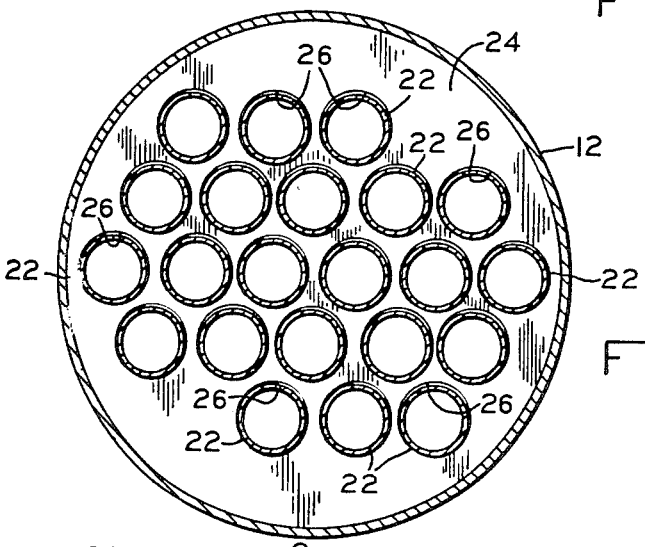
FIG. 2 is an enlarged cross-sectional view of the improved heat exchanger taken along line 2—2 of FIG. 1.

Referring also to FIG. 2, heat exchanger 10 is provided with a plurality of spaced apart circular baffles or plates 24 being disposed in transverse relation across the interior 16 of the shell 12 at spaced intervals along its length. The plates 24 have holes 26 formed therein in a pattern which matches that of the desired spacing of the tubes 22. The plates 24 with their holes 26 being aligned with one another receive the tubes 22 so as to provide support for the same at equal intervals along their lengths.

Figure 3:
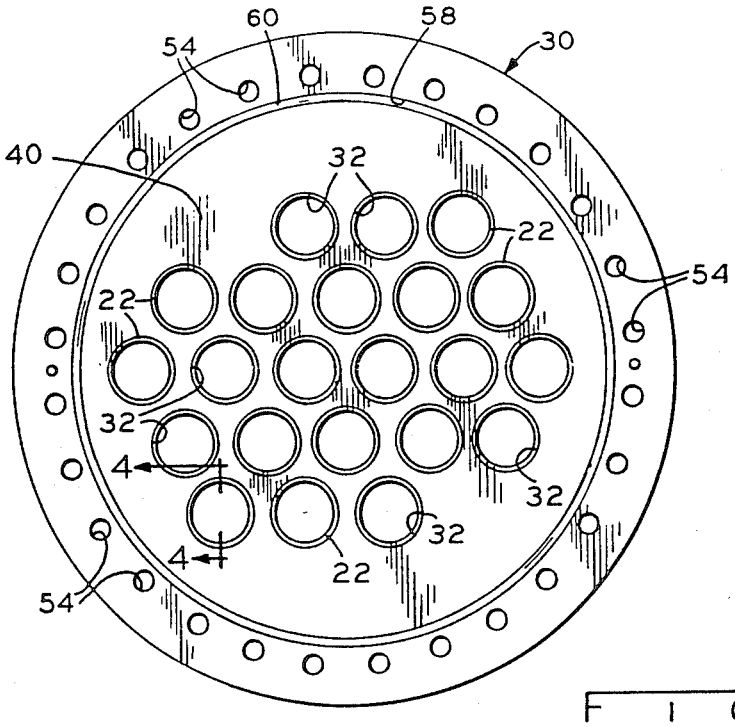
FIG. 3 is an enlarged end elevational view of the right tube sheet taken along line 3—3 of FIG. 1.
Figure 4:
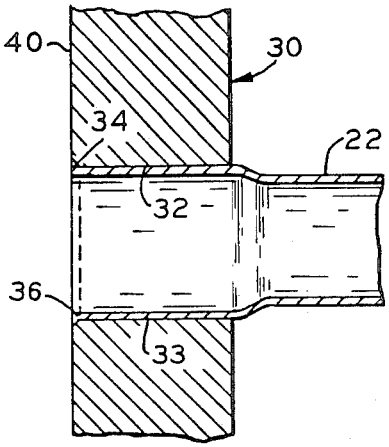
FIG. 4 is an enlarged fragmentary cross-sectional view of the tube sheet taken along line 4—4 of FIG. 3.

The opposite ends 28 of the tubes 22 are supported at the opposite ends 14 of the shell 12 by a pair of tube sheets 30, which are shown in FIGS. 2, 3 and 4. The tube sheets 30 are attached, such as by welding, to the respective opposite ends 14 of the shell 12. As illustrated in FIG. 3, each tube sheet 30 has a plurality of openings 32 defined therethrough in a pattern which matches that of the holes 26 in the plates 24 and the desired spacing of the tubes 22. Enlarged ends 33 of tubes 28 are respectively inserted within tube sheet openings 32 as depicted in FIG. 4, and are anchored therein by a slight enlargement of its diameter to snugly fit within the opening 32 and by forming a circumferential weld 34 about its outer edge 36 which connects with the portion of the tube sheet 30 defining the entrance of the opening 32.

Figure 5:
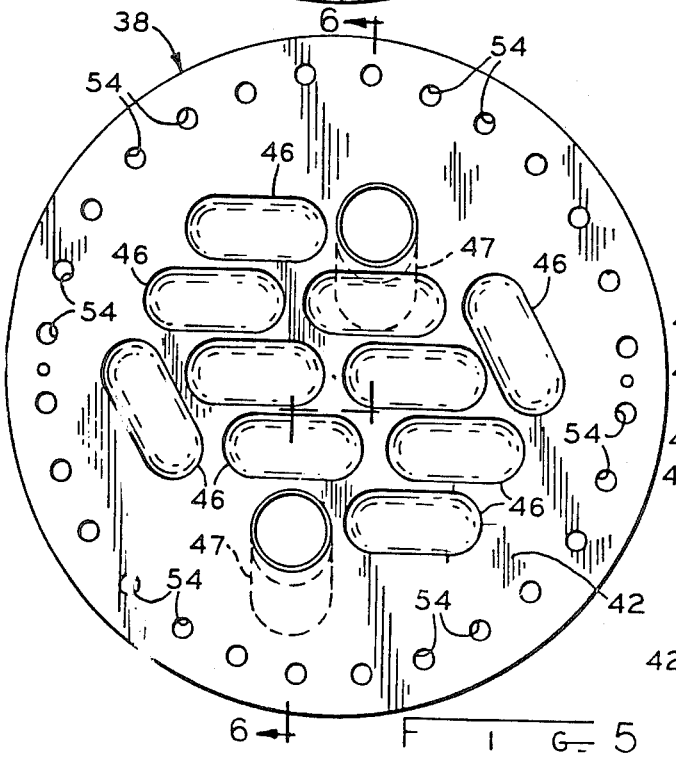
FIG. 5 is an enlarged and elevational view of the left end bonnet of the heat exchanger taken along line 5—5 of FIG. 1.
Figure 6:
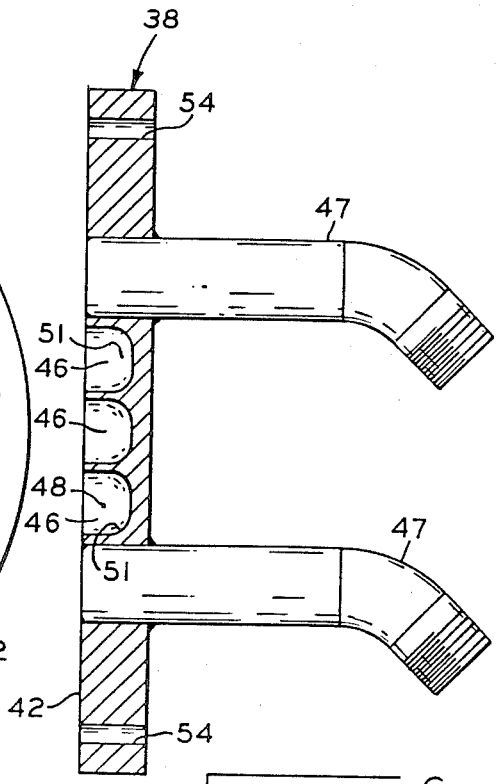
FIG. 6 is a cross-sectional view of the left end bonnet taken along line 6—6 of FIG. 5.

For closing its shell 12 and tubes 22 at their opposite ends 14, 28, the heat exchanger 10 is provided with end bonnets 38 shown in FIGS. 1, 5 and 6, releasably attachable to the respective tube sheets 30. The tube sheets 30 and end bonnets 38 have respective flat end surfaces 40, 42 which face toward each other and make substantially liquid tight mating contact with one another between the respective tube sheet and end bonnet pairs at the opposite ends 14 of the shell 12.

Each end bonnet 38 has a plurality of flow return pockets 46 defined in its one facing flat end surface 42. Each pocket 46 communicates the ends 33 of a pair of tubes 22 with each other to provide a return flow path for the liquid food product, allowing it to flow in reverse directions through the pair of adjacent tubes 22 communicating with the pair of openings. For instance, as depicted in FIG. 8, one of the pockets being identified as 46A communicates the pair of tubes 22A and 22B. Tubes 22A and 22B communicate with one another via the return pocket 46A independently of and separately from the other tubes 22. Inlet and outlet pipes 47 on the left end bonnet 38 (FIGS. 6 and 7) are connected with two of the pockets 46.

The sealing contact between the flat end surfaces 40, 42 of the tube sheet and end bonnet pair at each shell end 14 extends around and between the individual ones of the openings 32 and pockets 46 of the respective tube sheet and end bonnet pairs. Also, such mating contact eliminates the need of gasketing in these areas which would tend to catch solids carried in the liquid product and promote bacteria growth.

As seen in FIGS. 5–8, each of the pockets 46 are elongated and have a generally linear longitudinal axis 48 extending generally parallel to the respective flat end face 42 of the one end bonnets 38. Also, the openings 32 of the tube sheets 30 have respective central axes 50 which extend generally perpendicular to and intersect the longitudinal axes 48 of the respective pockets 46 which communicate the tube end 33 with one another. The pockets 46 have a cross-sectional flow area substantially the same as that of each of the tubes 22 so as to achieve streamlined return flow of the liquid product through the pockets 46 and between the tubes 22.

Figure 7:
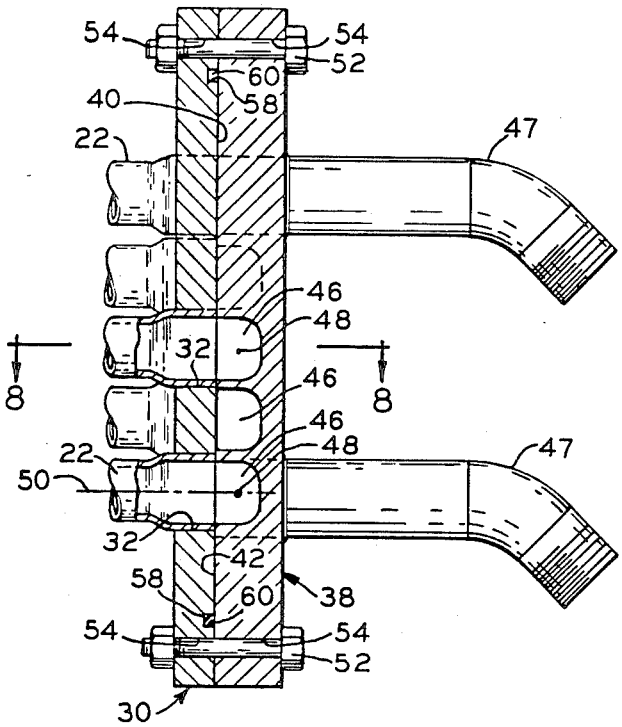
FIG. 7 is a sectional view of the left end bonnet showing the attached mating contact between the facing end surfaces of the left tube sheet and end bonnet of the heat exchanger.
Figure 8:
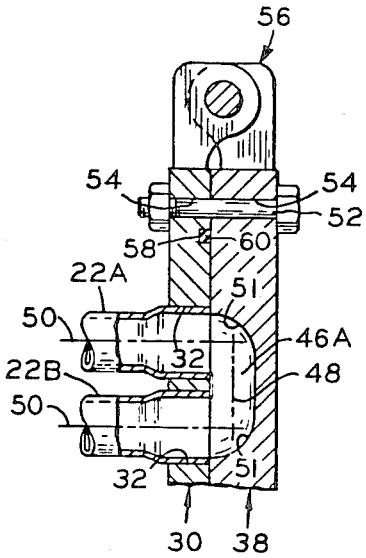
FIG. 8 is a fragmentary cross-sectional view taken along line 8—8 of FIG. 7.

As illustrated particularly in FIGS. 7 and 8, the inner peripheral surfaces of the open ends of tubes 22 mate with and are aligned over 180° of their periphery with the inner periphery of pockets or cavities 46.

Pockets 46 each have rounded corners 51 (FIGS. 6 and 8) to avoid turbulence and provide for a much more laminar flow of the material from one tube 22 to the other. In this way, sharp changes in flow direction are avoided, thereby resulting in lower pressure drop from one tube 22 to the other.

The pairs of tube sheets 30 and end bonnets 38 are releasably clamped together by bolts 52 fastened through complementary aligned holes 54 defined through the peripheral margins of the tube sheets and end bonnets. Each end bonnet 38 is mounted by a hinge 56 to its respective one tube sheet 30 for pivotal swinging movement between opened and closed positions relative thereto.

For providing additional sealing of the ends of the shell 12, a circular recess 58 is defined in the flat end surface 40 of each tube sheet 30 spaced inwardly of holes 54 and outwardly of openings 32. As seen in FIG. 3, the recess 58 encompasses openings 32 as a group which makes it easy to remove and replace gasket 60 each time the end bonnet 38 is detached from tube sheet 30. A sealing ring gasket 60 of food grade quality is disposed in the recess 58 and compressed therein when the end bonnet 38 is clamped to tube sheet 30.

Figure 9:
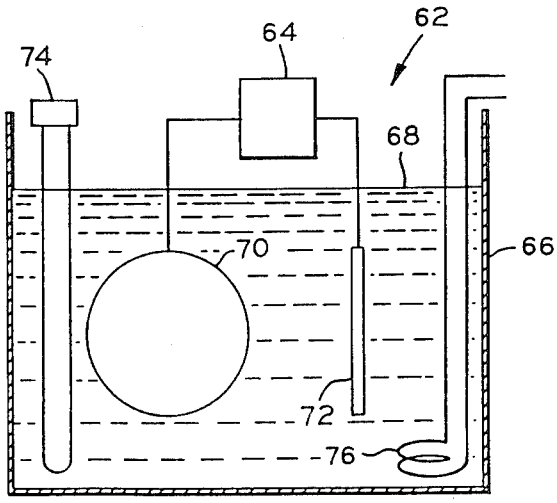
FIG. 9 is a diagrammatic representation of an equipment setup for electropolishing the tube sheets and end bonnets of the heat exchanger.

FIG. 9 diagrammatically represents a typical electropolishing cell, generally designated 62, used in a known manner for polishing the tube sheets 30 and end bonnets 38 of the heat exchanger 10. This not only further perfects the flatness of their mechanically ground, flat end surfaces 40, 42 by improving the surface microgeometry, but also improves corrosion resistance of stainless steel, of which these components as well as the rest of the parts of the heat exchanger 10 are made. Electropolishing passivates the stainless steel by removing free carbon molecules from the surface. This makes the surface of the stainless steel more neutral and is particularly advantageous in food product applications where it is important not to impart anything to the food product which would alter its flavor. The cell 62 includes a power source 64 and tank 66 holding an electrolytic acid bath 68 with an anode 70 and a cathode 72 therein electrically connected to the power source. Also, a heater and temperature regulator 74 and a cooling coil 76 are disposed in the bath 68. The item to be electropolished serves as the anode 70.

Electropolishing is a process whereby surface metal is removed by the process of anodic dissolution in a suitable electrolyte under an imposed current potential. During the process, surface irregularities, such as projections or depressions, are minimized by a leveling action that occurs as the metal is removed. For example, surface irregularities caused by welds are smoothed and leveled out thereby reducing friction and the occurrence of recesses where food particles can be trapped. Furthermore, the overall flatness of the surfaces of the tube sheets and bonnets is increased, thereby enhancing the liquid-tight seal between them as they are clamped together.

In operation, the liquid, such as crushed grape pulp, is pumped in through one of pipes 47 directly into one of tubes 22 and is pumped along that tube 22 to the pocket 46 in the opposite bonnet 38 where it encounters the rounded flow-reversing surface of the pocket 46 and changes direction. The pulp flows through pocket 46 and into the adjacent tube 22 opening into that pocket 26, whereupon it flows in the opposite direction through that tube 22 to the other bonnet 36, where it again encounters a flow-reversing pocket 46 to thereby change direction and flow again through another tube 22 within shell 10. This process repeats itself until the pulp has flowed through all of the tubes 22 and then flows out through discharge pipe 47. Because refrigerant is being circulated within shell 12, heat is transferred from the liquid food product to the refrigerant, thereby chilling the food product.

The improvements of the present invention and many of their attendant advantages will be understood from the foregoing description and it will be apparent that various changes may be made in the form, construction and arrangement of the parts thereof without departing from the spirit and scope of the invention, the forms hereinbefore described being merely preferred or exemplary embodiments thereof.

What is claimed is:

1. A heat exchanger useful for cooling a liquid food product, said heat exchanger comprising:

an elongate shell having opposite ends and a hollow interior through which a refrigerant can be circulated;

a plurality of hollow tubes having open ends and being housed within the interior of said shell and extending in generally parallel spaced relation to one another between the opposite ends thereof for carrying the liquid food product;

a pair of electropolished tube sheets attached to the respective opposite ends of said shell, said tube sheets having respective pluralities of openings defined therethrough and supporting said hollow tubes at opposite ends thereof in communication with said openings; and a pair of electropoilished end bonnets releasably attached to said respective tube sheets, said end bonnets having responsive pluralities of flow return pockets defined therein which communicate respective pairs of said openings and the tubes supported therein with one another independently of and separately from others of said openings and tubes;

substantially 180° of the inner periphery of each of said tube open ends mating with and being in alignment in the direction of fluid flow with respective portions of the inner periphery of a respective flow return cavity on the flat end surface of said end bonnets, whereby laminar flow of said liquid food product is promoted at the junction between said tube open ends and said flow return cavities;

said tube sheets and end bonnets having flat end surfaces which face one another and make substantially liquid tight mating contact with one another between respective tube sheet and end bonnet pairs at said opposite ends of said shell and about individual pairs of said openings and the respective pockets defined in the respective tube sheet and end bonnet;

each of said pockets being elongate and having a longitudinal axis, said longitudinal axis of each pocket extending generally parallel to said end surface of the respective end bonnet, said openings in each pair thereof communicating with one another via one of said pockets and having respective central axes which extend generally perpendicular to said longitudinal axis of said one pocket;

said each pocket also having rounded corners at opposite ends of said elongated pockets along said longitudinal axis, whereby laminar flow of said liquid food product is promoted at each corner of said each pocket;

each of said pockets having a cross-sectional flow area substantially the same as that of each of said tubes communicating with one another by the respective said pocket.

2. The heat exchanger as recited in claim 1 wherein each of said end bonnets is mounted at a respective end of said shell for pivotal movement between opened and closed positions relative to the respective tube sheet.

3. The heat exchanger as recited in claim 18 wherein:

each of said tube sheets has a circular recess defined in its end surface spaced inwardly of a peripheral edge of said surface and outwardly of said openings defined in said tube sheet, said recess encompassing said openings as a group; and a sealing ring gasket is disposed in said circular recess and compressed therein when a respective one of said end bonnets is clamped to said tube sheet with their end surfaces in mating contact.

* * * * *

UNITED STATES PATENT AND TRADEMARK OFFICE

CERTIFICATE OF CORRECTION

PATENT NO. : 4,747,449

DATED : May 31, 1988

INVENTOR(S) : Shelby W. Nickell

It is certified that error appears in the above-identified patent and that said Letters Patent is hereby corrected as shown below:

Claim 1, Col. 7, line 22, change "responsive" to --respective--;
Claim 3, Col. 8, line 28, change "18" to --1--.

Signed and Sealed this

Eighteenth Day of October, 1988

*Attest:*

DONALD J. QUIGG

*Attesting Officer*

*Commissioner of Patents and Trademarks*